US005480573A

United States Patent [19]

Durfee et al.

[11] Patent Number: 5,480,573

[45] Date of Patent: Jan. 2, 1996

[54] ELECTRORHEOLOGICAL FLUID COMPOSITIONS CONTAINING ALKYLMETHYLSILOXANES

[75] Inventors: Loren D. Durfee; Randall G. Schmidt, both of Midland, Mich.

[73] Assignee: Dow Corning Corporation, Midland, Mich.

[21] Appl. No.: 243,655

[22] Filed: Apr. 29, 1994

Related U.S. Application Data

[63] Continuation-in-part of Ser. No. 947,699, Sep. 21, 1992, abandoned.

[51] Int. Cl.[6] ..... C10M 169/04; C10M 171/00; C09K 3/00

[52] U.S. Cl. ..... 252/78.3; 252/73; 252/79; 252/572; 252/573

[58] Field of Search ..... 252/572, 573, 252/78.3, 73, 79

[56] References Cited

U.S. PATENT DOCUMENTS

| | | | |
|---|---|---|---|
| 4,429,345 | 1/1984 | Vincent | 361/315 |
| 4,645,614 | 2/1987 | Goossens et al. | 252/75 |
| 4,812,251 | 3/1989 | Stangroom | 252/75 |
| 4,946,611 | 8/1990 | Kaneko | 252/49.6 |
| 4,994,198 | 2/1991 | Chung | 252/78.3 |
| 5,032,307 | 7/1991 | Carlson | 252/73 |
| 5,075,023 | 12/1991 | Fukuyama et al. | 252/74 |

FOREIGN PATENT DOCUMENTS

| | | | |
|---|---|---|---|
| 0372366 | 6/1990 | European Pat. Off. | C10M 171/00 |
| 0457597 | 11/1991 | European Pat. Off. . | |
| 0457597A1 | 11/1991 | European Pat. Off. | C10M 171/00 |
| 132871 | 12/1989 | Japan | C08L 33/00 |
| 1224885 | 11/1967 | United Kingdom | C10M 1/50 |
| 1570234 | 6/1980 | United Kingdom | C08L 33/02 |
| 2210893 | 6/1989 | United Kingdom | C10M 171/00 |

*Primary Examiner*—Christine Skane
*Attorney, Agent, or Firm*—Timothy J. Troy

[57] ABSTRACT

The present invention relates to an electrorheological fluid comprising solid particles, an alkylmethylsiloxane compound, and an organofluoro compound. Preferred solid particles include zeolite and sulfate ionomers of aminofunctional siloxanes. The ER fluids of the present invention are characterized by improved dispersion stability, enhanced lubricity, and high yield stresses.

18 Claims, No Drawings

ELECTRORHEOLOGICAL FLUID COMPOSITIONS CONTAINING ALKYLMETHYLSILOXANES

This is a continuation-in-part of copending application Ser. No. 07/947,699, filed on Sep. 21, 1992, now abandoned.

BACKGROUND OF THE INVENTION

The present invention relates to an electrorheological (ER) fluid composition. More particularly, this invention relates to an ER fluid comprising a solid phase dispersed in a base liquid wherein the base liquid comprises a miscible mixture of an alkylmethylsiloxane fluid and one or more organofluoro compounds such that the miscible base fluid mixture has a specific gravity within 0.2 of the solid phase.

When certain polarizable solid particles are dispersed in an electrically non-conducting hydrophobic liquid, the resulting suspensions exhibit peculiar rheological properties under the influence of an electrical field. These systems show a dramatic increase in viscosity and modulus with applied voltage, in some cases literally being transformed from a liquid to a virtual solid upon the application of the electric field. This change is reversible and typically takes place in a matter of milliseconds. Materials which exhibit this phenomenon are called electrorheological (ER) or electroviscous (EV) fluids, and have been known for at least the last fifty years. These fluids find utility in such areas as torque transfer and mechanical damping applications.

The early ER fluids comprised such systems as starch dispersed in transformer oil or silica gel dispersed in kerosine or mineral oil. Since these early discoveries, only a relatively small number of improvements over old ones have emerged in this art.

It is desirable in the ER fluid art to improve the strength of such fluids which thereby permits smaller devices requiring less power to be utilized. The production of an ER fluid with greater strength would also allow devices to be operated at lower voltages, which would have advantages in power supply design, and generally would open up other application areas for the use of ER fluids that are currently beyond the capabilities of existing ER fluids.

Polychlorotrifluoroethylene (CTFE) when blended with hydrophilic particles functions as an active base fluid for electrorheological (ER) fluid systems. However its high specific gravity (1.9) often limits its utility with lower specific gravity particle systems based on organic or siloxane polymers due to the poor stability of the resulting dispersion. Also, the loss currents of many ER fluids based on CTFE have been found to be prohibitively high.

Fluids which are effective base fluids have been described in the ER fluid art. For example, Stangroom, in Great Britain patent specification No. 1,570,234 (to the Secretary of State of Defense, London) teaches an ER fluid comprising a lithium salt of polymethacrylic acid (LMAA) as the solid phase, and a chlorinated paraffin as the base liquid. Although these ER fluids have been moderately successful, they are nonetheless deficient in a number of properties. For example, their zero-field viscosity is relatively high, which in some instances can make it difficult to control the fluid. Also, they have a relatively high pour-point, resulting in an undesirably high viscosity at low temperatures, while on the other hand at high temperatures they start to decompose to highly corrosive by- products including hydrochloric acid. Therefore the useful temperature range of these ER fluids is limited which prevents their widespread adoption in many industries eg. the automotive industry, where ER fluids could otherwise be useful.

ER fluids employing silicone oil as the base fluid phase have also been disclosed. For example, Goossens et al., in U.S. Pat. No. 4,645,614, teaches an electroviscous suspension which is based on a mixture of aqueous silica gel with silicone oil as the liquid phase to which a dispersant is added. The dispersant consists of amino, hydroxy, acetoxy, or alkoxy functional polysiloxanes having a molecular weight above 800. The electroviscous suspensions are disclosed as being highly compatible with elastomeric materials, non-sedimenting, non-flammable and physiologically acceptable. They are also described as heat and freeze resistant over a wide temperature range and are largely unaffected by temperature and pressure in their viscosity.

Carlson, in U.S. Pat. No. 5,032,307 teaches an ER material containing a carrier fluid, an anionic surfactant particle component, and an activator. The non-abrasive anionic surfactant acts as both a particle component and a surfactant and the ER material is miscible with water and will not mar the surface of objects utilized in an ER device. The preferred carrier fluids of Carlson are silicone oils having viscosities of between about 0.65 and 1000 milliPascal seconds (mPa.s).

Stangroom, in U.S. Pat. No. 4,812,251, teaches an ER fluid comprising a hydrophilic solid and a hydrophobic liquid component wherein the hydrophobic liquid component comprises a fluorosilicone whose average molecular weight is in the range of 200–700. The reduction of the molecular weight of the fluorosilicone of Stangroom to the above described range is disclosed as having two desirable effects, one is that it reduces the viscosity of the fluorosilicone itself, and secondly it renders the fluorosilicone miscible with CTFE. However addition of the fluorosilicone fluids has done little to reduce the loss currents of such systems.

Siloxanes have also been disclosed in the ER fluid art as being useful as base fluids. For example, Brooks et al. in Great Britain Unexamined Application No. 2210893, teaches an ER fluid comprising a solid phase dispersed in a base liquid which is characterized in that the base liquid comprises a polyfluoroalkylmethylsiloxane. The ER fluids of Brooks et al. are disclosed as having improved strength and stability and are taught as being useful in fluid power systems and engineering applications such as in clutches, brake systems, fluid drives, and couplings.

Hashimoto et al., in Japanese Patent Application Laid Open No. 01304144, teaches an electroviscous liquid which comprises an inorganic solid or fine powder dispersion modified with an alkoxysilane. The liquid is prepared by dispersing an inorganic solid or inorganic fine powder in water or organic solvent, and then modifying the resulting dispersion with an alkoxysilane having hydrophobic substitution, the substitutes being monovalent and divalent aliphatic, aromatic or unsaturated hydrocarbons. An emulsion results which is then added to silicone oil to prepare the final product of electroviscous liquid. Preferred silicone oils to be used as dispersion media for the electroviscous liquid of Hashimoto et al. include homopolymers or copolymers made of units selected from among polydimethylsiloxane, polymethylphenylsiloxane, polydiphenylsiloxane, polymethylchlorophenylsiloxane, polymethyl-long-chain-alkylsiloxane, polymethylcyanopropylsiloxane, and polymethyl-3,3,3-trifluoromethylsiloxane as well as their mixtures.

However, none of the references described hereinabove teach a mixture of linear and/or cyclic alkylmethylsiloxane oils and organofluoro compounds as base fluids which provide improved ER performance properties and much improved lubricity in comparison to polydimethylsiloxane based ER fluids. The present invention also teaches how to obtain miscible base fluids enabling control of the specific gravity of the base fluid mixture, the range of which is controlled by the specific gravity and concentration of the mixture components such that it can be matched with that of the dispersed phase to provide enhanced dispersion stability.

SUMMARY OF THE INVENTION

The present invention is an electrorheological (ER) fluid which provides improved dispersion stability characteristics and lubricity while maintaining good ER performance compared to fluids heretofore described in the art. It has now been discovered that certain alkylmethylsiloxanes when mixed with organofluoro containing compounds, the mixture of which is used as the base fluid in the present invention, can when utilizing a wide variety of substances as the solid phase provide novel ER fluids having desirable properties. In the preferred embodiments the present invention can provide properties superior to those of ER fluids currently available in commerce especially in the area of dispersion stability and lubricity with other standard ER base fluids. The compositions of the present invention offer distinct advantages over prior art systems since they provide greatly improved ER performance while maintaining good dispersion stability in compatible base liquids or mixtures.

It is an object of the present invention to provide a low specific gravity base fluid which displays miscibility and therefore compatibility with other known high specific gravity base fluids.

Another object of this invention is to provide an ER fluid which provides increased lubricity which is critical to ER fluid applications which typically involve the fluid in contact with metal parts.

It is also an object of this invention to provide an ER fluid which maintains good dispersion stability in properly prepared mixtures of compatible base fluids.

These and other features, objects and advantages of the present invention will be apparent upon consideration of the following detailed description of the invention.

DETAILED DESCRIPTION OF THE INVENTION

The present invention relates to an electrorheological fluid composition comprising (A) solid particles having a specific gravity of less than 1.8, (B) an alkylmethylsiloxane compound having a specific gravity of between 0.8 and 1.0 and having its formula selected from the group consisting of

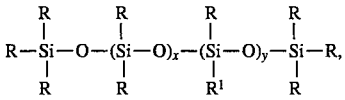

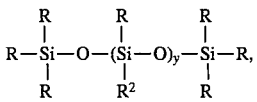

-continued

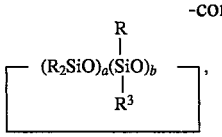

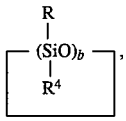

and mixtures thereof; and (C) an organofluoro compound having a specific gravity of greater than 1.5, wherein each R is a radical independently selected from the group consisting of alkyl radicals having from 1 to 20 carbon atoms, haloalkyl radicals having from 1 to 20 carbon atoms, cycloalkyl radicals having from 4 to 20 carbon atoms, and aryl radicals, $R^1$, $R^2$, $R^3$, and $R^4$ have the general formula $(CH_2)_dCH_3$ and d has an average value from 5 to 11, x has an average value from 1 to 100, y has an average value from 1 to 100, a has an average value from 1 to 9, and b has an average value from 1 to 10, with the proviso that the mixture has a viscosity of below 10,000 centistokes at 25° C. and with the proviso that (B) is miscible with (C) and wherein the average specific gravity of (B) plus (C) is within 0.2 of the specific gravity of (A).

For purposes of the present invention, miscibility denotes the ability of a liquid to dissolve, disperse, or blend uniformly in another liquid.

Thus the present invention broadly provides for an ER fluid of the type comprising a solid phase dispersed in a base fluid phase, wherein the base fluid phase comprises a miscible mixture of a $C_6$ to $C_{12}$ alkylmethylsiloxane fluid and an organofluoro compound.

Component (A) in the compositions of the instant invention are solid particles having a specific gravity of less than 1.8 which are used to form the dispersed phase in the ER fluids of this invention. Examples of solid particles (A) which are suitable for the solid phase of the present invention include acid group-containing polymers, silica gel, starch, electronic conductors, zeolite, sulfate ionomers of aminofunctional siloxanes, amino acid containing metal polyoxo-salts, organic polymers containing free salified acid groups, organic polymers containing at least partially salified acid groups, homopolymers of monosaccharides or other alcohols, copolymers of monosaccharides or other alcohols, and copolymers of phenols and aldehydes or mixtures thereof. Salified for purposes of the present invention means to form or convert into a salt, or mixed with a salt. Preferred as solid particles in the ER fluids of the present invention are corn starch, carboxy modified polyacrylamides, lithium salts of polymethacrylic acid, zeolite, amino acid containing metal polyoxo-salts, and sulfate ionomers of aminofunctional siloxanes.

One preferred class of materials to form the dispersed phase of the ER fluids of this invention are the acid group-containing polymers which are taught in Great Britain patent specification No. 1,570,234, hereby incorporated by reference. It is preferred to employ acid-group containing polymers in which the acid groups are free or at least partially neutralized, particularly by metal cations selected from Groups I, II, and III of the Periodic Table, such as lithium, sodium, potassium, copper, magnesium, aluminum, and chromium. A particularly preferred class of polymer for the polymeric backbone is an addition polymer containing at least one monomer which has at least one acid group and/or at least one group convertible to an acid group after polymerization. Exemplary of such monomers are acrylic acid, methacrylic acid, methyl acrylate, and methyl methacrylate.

In order for an ER effect to be exhibited using acid group-containing polymers as the disperse phase, it is necessary for a small amount of water to be present in the ER fluid as is well known to those skilled in this art.

The successful development of electrorheological properties with other substances conventionally used to form the dispersed phase such as starch and silica gel also requires the presence in the ER fluid of a minimum amount of water. However, a new class of solid phase materials which function under anhydrous conditions has recently been taught in Great Britain Patent Specification No. 2170510 which is hereby incorporated by reference. These new solid phase materials are electronic conductors, particularly organic semiconductors, and such may be used in conjunction with mixtures of $C_6$ to $C_{12}$ alkylmethylsiloxane compounds and organofluoro compounds in accordance with the present invention to provide ER fluids of particularly advantageous properties.

The solid particles of the present invention can also be amino acid containing metal polyoxo-salts such as those disclosed in U.S. application for patent, Ser. No. 07/874,450, filing date Apr. 27, 1992, and assigned to the same assignee as this present application, now U.S. Pat. No. 5,320,770 incorporated herein by reference. These solid particles are generally compounds having the general formula:

$$[(M)^p(H_2O)_x(OH)_y]^q{}_c\ [A]^r{}_d.B_z.nH_2O$$

wherein M is a metal cation or a mixture of metal cations at various ratios; p is the total valence of M and has a value of greater than zero; x is zero or has a value greater than zero, y is zero or has a value greater than zero, with the proviso that only one of x or y can be zero at any given time; q has a value of p minus y with the proviso that q has a value of at least one; c has a value of greater than zero; A is an anion or a mixture of anions at various ratios; r is the total valence of A with the proviso that r has a value of at least one; d has a value of greater than zero with the proviso that (q×c) is always equal to (r×d); B is an amino acid or a mixture of amino acids; z has a value of from 0.01 to 100; and n is a number from 0 to 15.

Preferably the solid particles are silicone ionomers. The preferred silicone ionomers are those which are a reaction product of (I) an amine functional diorganopolysiloxane having a degree of polymerization of less than about 10,000 in which at least about 3 mole percent of the silicon atoms have attached thereto, through silicon-carbon bonds, an amine functional organic group bearing at least one —NHR" group, in which R" is selected from the group consisting of hydrogen and an alkyl radical having from 1 to 6 carbon atoms, and (II) an acid such as those described by Chung, in U.S. Pat. No. 4,994,198 incorporated herein by reference. It is highly preferred for purposes of the present invention that the solid particles are sulfate ionomers of aminofunctional siloxanes.

The particle size of the solid phase of the present invention preferably should lie within the range from 1–50 microns, and more preferably be from 5–30 microns. The particle size of the solid dispersed in the novel base fluid of the present invention is not critical, however the average particle size successfully employed in the fluid of the invention was about 10 microns. It is also required that the specific gravity of the solid particles be less than 1.8.

Typically, from about 5 to about 40 weight percent of the solid particles (A) by volume of the fluid are dispersed into a mixture of the alkylmethylsiloxane compounds (B) and organofluoro compounds (C) of the present invention. Preferably about 20 to about 40 weight percent of the solid particles by volume of the fluid are dispersed into the fluid phase for the compositions of the present invention. However, the optimum amount that is used depends greatly on the specific type of solid particle that is employed, the type of alkylmethylsiloxane base liquid that is selected, fluid viscosity, and intended application, among other variables. Those skilled in the art will readily determine the proper proportions in any given system by routine experimentation.

Alkylmethylsiloxanes having a specific gravity of between 0.8 and 1.0 suitable as component (B) of the present invention are preferably alkylmethylsiloxanes described by formulas (1) and (2) hereinbelow:

$$R_3SiO(R_2SiO)_x(RR^1SiO)_ySiR_3 \quad (1)$$

where x is number from 0 to 99, y is a number from 1 to 100, and x+y has a value of up to 100. Preferably x has a value from 0 to 9 and y has a value of 1 to 10. The alkylmethylsiloxanes can also be described by the formula $$\left[(R_2SiO)_a(RR^2SiO)_b\right] \quad (2)$$

where a is a number from 0 to 9, b is a number from 1 to 10, and a+b has a value of up to 10. Preferably a is a number from 0 to 3, and b is a number from 1 to 4. Each R is a radical independently selected from the group consisting of alkyl radicals having from 1 to 20 carbon atoms, haloalkyl radicals having from 1 to 20 carbon atoms, cycloalkyl radicals having from 4 to 20 carbon atoms, and aryl radicals. The R radical can be, for example, methyl, ethyl, propyl, decyl, cyclohexyl, phenyl, a-methylstyryl, or 3,3,3- trifluoropropyl. Preferred is where R is methyl. Each $R^1$ and $R^2$ have the general formula $(CH_2)_dCH_3$ wherein d has an average value from 5 to 11.

The alkylmethylsiloxanes (B) of the present invention are mixed with (C) an organofluoro compound having a specific gravity of greater than 1.5 and having a viscosity up to 10,000 cs at 25° C. to form the base fluid in the electrorheological fluids of the present invention. Examples of organofluoro compounds (C) that may be used in combination with the alkylmethylsiloxane fluids described hereinabove include perfluorinated fluids, perfluoropolyethers, perfluorodecalin ($C_{10}F_{18}$), perfluoromethyldecalin ($C_{11}F_{20}$), and fluoro/chloro fluids. Preferably the perfluoropolyethers have a general formula selected from the group consisting of $$F-(\underset{\underset{CF_3}{|}}{C}FCF_2O)_n-CF_2CF_3,$$

$F-(CF_2CF_2CF_2O)_n-CF_2CF_3$ and $F_3C-(OCF_2-CF_2)_nOCF_3$, where n is such that the viscosity of the perfluoropolyether is less than 500 centistokes at 25° C., or have the general formula: $F_3C-\{(OCF_2-CF_2)_a-(OCF_2)_b\}-OCF_3$ where a can have a value from 0 to 50 and b can have a value from 0 to 75. Organofluoro compounds which are also useful in combination with the alkylmethylsiloxanes described hereinabove to form the base fluid for the electrorheological fluids of the present invention include compounds having the general formula: $(CR_3R^4-CR^5R^6)_n$ where $R^3$, $R^4$, $R^5$, and $R^6$ can be hydrogen, chlorine, or fluorine, with the proviso that at least one of $R^3$, $R^4$, $R^5$, and $R^6$ is a fluoro group, and n is such that the viscosity of the organofluoro compound is less than 500 centistokes at 25° C. A highly preferred organofluoro compound is chlorotrifluoroethylene (CTFE). Perfluorinated fluids useful as (C) in the compositions of this invention have the structure $F_3C(CF_2—CF_2)_nCF_3$ where again n is such that the viscosity of the perfluorinated fluid is less than 500 centistokes at 25° C.

The base fluid (a mixture of (B) and (C) described hereinabove) may suitably have a viscosity up to about 10,000 centistokes (cs) at 25° C., but for the majority of applications the viscosity should be in a range of from 10 to 500 cs at 25° C., more preferably from 20 to 300 cs, and most preferably from 20 to 100 cs. A desired viscosity within the ranges indicated above may be obtained by varying the molecular weight of the siloxane backbone (x and y in the formula above) and the length of the alkyl side chain (d in the formula described hereinabove).

The ratio of the amount alkylmethylsiloxane compound (B) to organofluoro compound (C) is not critical in the instant compositions as long as at least one weight percent of organofluoro compound is mixed with the alkylmethylsiloxane compounds of the present invention. However as much as 99 weight percent organofluoro compound and 1 weight percent of alkylmethylsiloxane compound can be used to form the base fluid of the instant invention. It is required that the two compounds be a mixed at a ratio such that the average specific gravity of (B) plus (C) (i.e. the specific gravity of (B) plus the specific gravity of (C) divided by two) is within 0.2 of the specific gravity of solid particles (A).

Dispersion of the solid particles (A) in the alkylmethylsiloxane-organofluoro fluid mixture of the present invention is preferably accomplished by any of the commonly accepted methods, such as those employing a ball mill, paint mill, high shear mixer, inter alia. During this dispersion process, the solid particles and alkylmethylsiloxane-organofluoro base fluid are sheared at a high rate, thereby reducing the size of the particles. It has been found that a final particle size having an average diameter of about 5 to 100 micrometers is preferred. If the diameter is above this range, the particles tend to settle out and limit the number of particles that can fit between the electrodes, while if the diameter is too low, thermal Brownian motion of the particles tends to reduce the ER effect.

An equivalent dispersion of the solid particles in the alkylmethylsiloxane-organofluoro fluid mixtures may also be effected by first grinding the particles to a suitable fineness and subsequently mixing in the liquid component or spray drying solid particles in the base fluid mixtures of the present invention.

If desired, a dispersant such as a hydrogenated castor oil may be incorporated, but it is an advantage of the ER fluids of the present invention that they are in general quite physically stable and do not require the inclusion of a dispersant to maintain the solid phase sufficiently dispersed. The ER fluid compositions of the present invention may further comprise antioxidants, stabilizers, colorants, and dyes.

Electrorheological fluids of this invention find utility in many of the applications now being serviced by current art ER fluid compositions. Examples of this diverse utility include torque transfer applications such as traction drives, automotive transmissions, and anti-lock brake systems; mechanical damping applications such as active engine mounts, shock absorbers, and suspension systems; and applications where controlled stiffening of a soft member is desired such as hydraulic valves having no moving parts and robotic arms. The compositions of the present invention find particular utility in applications requiring an ER fluid which supplies greater miscibility with fluoro fluids than other conventional base fluids which enables ER base fluids with a wide range of specific gravities to be formulated. Consequently, ER fluids with excellent dispersion stability can be prepared using ER active particles consisting of an equally wide range of specific gravities through matching of the specific gravities of the fluid and particulate phases. The compositions of the present invention also enable ER fluids with improved lubricity to be produced.

The compositions of the present invention were tested for Yield Stress and Current Density in comparison to ER fluids not containing alkylmethylsiloxane fluids as part of the base fluid. A Rheometrics RSR rheometer is used for measuring the yield stress. The rheometer motor applies a torque to the upper test fixture which results in a shear stress being applied to the sample. The amount of stress is a function of the test fixture and the torque. Parallel plates are employed for ER fluid yield stress testing. The plate diameters range from 8 millimeters (mm) to 50 mm. The strain in the material is a function of the sample geometry and the rotation of the upper parallel plate. From the stress applied and the resulting strain, a stress/strain curve is plotted to determine the yield stress, which is the point where a small increase in stress results in a large increase in strain.

The application of an electric field to the instrument test fixture required modifications of the rheometer. An adaptor was made from a high dielectric strength phenolic resin and placed between the motor coupling and upper test fixture. A new base was made of the same phenolic resin. The lower test fixture was readily equipped with an electrical lead due to its fixed position. The upper electrode required a brush type connection with very low friction. This was accomplished with copper foil attached to a piece of high voltage wire.

The current density of the samples was also tested. During any mechanical test the current is monitored using a picoammeter which is in series with the power supply located between the test sample and the earth ground.

The dispersion stability of the ER fluid samples were tested by observing the fluid mixtures for signs of particle/fluid or fluid/fluid separation. The lubricity of the ER fluids in the Examples hereinbelow were evaluated according to the method detailed in American Society for Testing Materials standard ASTM D 2266-67. In summary, this method covers the determination of the wear preventative characteristics of greases including steel-on-steel applications. In the above method a steel ball is rotated under load against three stationary balls having ER fluid lubricated surfaces. The diameters of wear scars on the stationary balls are measured after completion of the test.

EXAMPLE I

In order to illustrate the strength, stability, lubricity, and miscibility with other base fluids the following tests were performed on the electrorheological fluids of the present invention. All parts and percentages in the examples are on a weight basis unless indicated to the contrary. The following fluids were utilized in this Example:

Fluid A is a well known base fluid for ER fluid compositions is described in Table I hereinbelow and is a 20 centistoke (cs) polydimethylsiloxane polymer having the general formula:

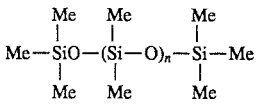

Fluid B is a fluid component of the present invention which is described in Table I hereinbelow and is a Hexyl-methyl Cyclic Tetramer siloxane having the average formula:

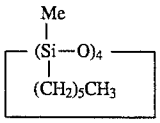

Fluid C is a fluid component of the present invention which is described in Table I hereinbelow is a Decyl-methyl Dimethyl Linear siloxane copolymer having the average formula:

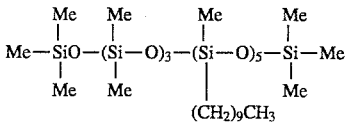

Fluid D is Polychlorotrifluoroethylene (CTFE) having a viscosity of 27 centistokes.

The ER fluids were then prepared by dispersing either zeolite particles or sulfate ionomer of aminofunctional siloxane particles into one of the fluids (A, B, C, or D described above). The amounts (weight percent) of particles employed is delineated in Table I hereinbelow. The 100% Amine Sulfate particles (100 mole % amine hydrolyzate sulfate ionomer particles) were prepared according to the disclosure of Chung et al., U.S. Pat. No. 4,994,198. The amine hydrolyzate sulfate ionomer particles were prepared by combining an amine hydrolyzate which was a mixture of linear and cyclic organopolysiloxanes having the formula $OCH_3RCH_3SiO(CH_3RSiO)_xSiCH_3RCH_3O$ having a viscosity on average of about 1300 centistokes and wherein R is $CH_2CH(CH_3)CH_2NHCH_2CH_2NH_2$ with sulfuric acid in an aqueous solution. A ratio of one mole of $H_2SO_4$ to one mole of R was used to prepare the particles. The water was then removed to produce the 100 mole percent amine hydrolyzate sulfate ionomer particles.

TABLE I

| FLUID | PARTICLE | LOADING | YIELD STRESS (PA) (2 kV/mm) | WEAR SCAR (mm) |
|---|---|---|---|---|
| A | ZEOLITE | 33 | 290 | 2.01 |
| B | ZEOLITE | 33 | 435 | 1.24 |
| C | ZEOLITE | 33 | 410 | .78 |
| A | Amine Sulfate (100%) | 33 | 1135 | 1.95 |
| B | Amine Sulfate (100%) | 33 | 1485 | 2.02 |
| C | Amine Sulfate (100%) | 33 | 1180 | .93 |
| D | Amine Sulfate (100%) | 33 | — | .55 |

Table I shows that the base fluid components of the present invention exhibited increased yield stress and provided enhanced lubricity compared to the base fluids described in the art. Thus the base fluid components of the present invention displayed an increase in yield stress along with accompanying improved lubricity characteristics in contrast to an ER fluid composition using a well known base fluid.

Example II

Alkylmethylsiloxanes with the alkyl group consisting of Cn radicals where n>6 exhibit good lubricity as do fluorosilicones and CTFE. The miscibility of CTFE with good lubricity siloxane fluids were analyzed by mixing equal volumes in a ½ ounce vial, shaking vigorously for 1 minute, and observing the mixture for miscibility after 3 days at room temperature or after 3 days at 80° C. Clear solutions with no sign of phase separation were considered miscible (M).

The miscibility of 4.2 cs and 27 cs CTFE (Halocarbon) were analyzed with cyclic and linear alkylmethylsiloxanes and two fluorosilicone fluids (two trifluoropropylmethylsiloxane fluids-one having a viscosity of 300 cs and one containing volatiles distilled from the 300 cs fluid) at both room temperature and 80° C. The results are reported in Table II hereinbelow.

TABLE II

| | CTFE RT | 4.2 cs 80° C. | CTFE RT | 27 cs 80° C. |
|---|---|---|---|---|
| C6 Linear | M | M | I | M |
| C8 Linear | M | M | I | M |
| C10 Linear | M | M | I | M |
| C12 Linear | M | M | I | M |
| C14 Linear | M | M | I | I |
| C6 Cyclic | M | M | M | M |
| C8 Cyclic | M | M | M | M |
| C10 Cyclic | M | M | I | M |
| C14 Cyclic | M | M | I | I |
| FluoroSi (300 cs) | I | I | I | I |
| FluoroSi (volatiles) | I | M | I | M |

M = Miscible
I = Immiscible

Unexpectedly, the alkylmethylsiloxanes exhibited better miscibility than the fluorosilicone materials with CTFE. Also, the cyclic alkylmethylsiloxanes exhibited greater miscibility than their linear analogs. The low specific gravity of alkylmethylsiloxane fluids coupled with their unexpected miscibility with CTFE (a high specific gravity fluid) over certain compositional ranges and their good lubricity allow mixtures of CTFE and alkylmethyl siloxanes to be used as ideal base fluids for ER fluids. These mixtures can be tailored to match the specific gravity of a wide range of particle systems and hence provide good dispersion stability. Also, the good lubricity of both components will reduce the wear of metal parts by the ER fluid composition during use.

EXAMPLE III

The following ER fluids were prepared as dispersions of particles in mixtures of fluids described hereinbelow. The ER fluids were tested for yield stress, current density and dispersion stability in this Example. The following Fluids were tested and the results are described in Table III below.

Fluid 1 is Chlorotrifluoroethylene (CTFE) which has a specific gravity of 1.9.

Fluid 2 is a mixture of Fluorosilicone volatile fluids and has a specific gravity of 1.15.

Fluid 3 is an alkylmethylsiloxane compound having the formula $Me_3SiO(Me_2SiO)_3(RMeSiO)_5SiMe_3$ wherein R is a $(CH_2)_5CH_3$ alkyl group and has a specific gravity of 0.92.

Fluid 4 is an alkylmethylsiloxane compound having the formula $Me_3SiO(Me_2SiO)_3(RMeSiO)_5SiMe_3$ wherein R is a $(CH_2)_9CH_3$ alkyl group and has a specific gravity of 0.90.

Fluid 5 is an alkylmethylsiloxane compound having the formula $Me_3SiO(Me_2SiO)_3(RMeSiO)_5SiMe_3$ wherein R is a $(CH_2)_1CH_3$ alkyl group and has a specific gravity of 0.89.

Fluid 6 is an alkylmethylsiloxane compound having the formula $Me_3SiO(Me_2SiO)_3(RMeSiO)_5SiMe_3$ wherein R is a $(CH_2)_{17}CH_3$ alkyl group and has a specific gravity of 0.88.

Fluid 7 is an alkylmethylsiloxane compound having the formula

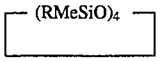

wherein R is a $(CH_2)_9CH_3$ alkyl group and has a specific gravity of 0.89.

The following Particles were employed and were blended with the above Fluids in this Example:

Particle A is Corn Starch and has a specific gravity of 1.5.

Particle B is a Carboxy modified Polyacrylamide and has a specific gravity of 1.3.

Particle C is a Polymethacrylic Acid Lithium Salt (Li-PMMA) and has a specific gravity of 1.4.

Particle D is a Polymethyldiaminosiloxane Sulfate Salt (prepared according to the disclosure of Chung et al., U.S. Pat. No. 4,994,198 as described above) and has a specific gravity of 1.2.

The designations in Table II shown hereinbelow have the following meanings:

+ means that the viscosity of the fluid exceeded 5000 centistokes.

* means that the Current Density of the fluid was too high to test safely at 2 kV/mm (J>40 uA/cm$^2$).

a means that the fluid had excellent dispersion stability and showed no signs of separation for over 2 weeks.

b means that the fluid had good dispersion stability and only within a one to two week period did particles separate out as the top phase.

c means that the fluid had good dispersion stability and only within a one to two week period did particles separate out as the bottom phase.

d means that the fluid had poor dispersion stability and the fluid phases remained compatible for less than one week.

All samples containing more than one type of fluid were formulated so that the specific gravity of the respective fluids/mixtures is equivalent to the specific gravity of the particle dispersed in the fluid. The amount of particles dispersed in the fluid(s) was 25 percent based on volume in all samples.

TABLE III

| FLUID(S) | PARTICLE | YIELD STRESS Pa @ 2 KV/mm | CURRENT DENSITY | DISPERSION STABILITY uA/cm$^2$ | VISCOSITY (CP) RATING |
|---|---|---|---|---|---|
| 1 | A | 140 | .003 | d | 56.33 |
| 1 | B | * | * | d | 517.40 |
| 1 | C | * | * | d | 2831.00 |
| 1 | D | + | + | b | >5000.00 |
| 1 and 2 | A | 150 | .004 | b | 72.43 |
| 1 and 2 | B | 1500 | 20.4 | b | 55.48 |
| 1 and 2 | C | * | * | a | 239.10 |
| 1 and 2 | D | + | + | a | >5000.00 |
| 1 and 3 | A | 260 | .002 | c | 143.20 |
| 1 and 3 | B | 1500 | 2.2 | b | 371.40 |
| 1 and 3 | C | 800 | 18.3 | a | >5000.00 |
| 1 and 3 | D | 1000 | .003 | c | 1844.00 |
| 1 and 4 | A | 700 | .002 | c | 27.41 |
| 1 and 4 | B | 300 | 17.3 | c | 56.09 |
| 1 and 4 | C | 1000 | 9.4 | a | 100.00 |
| 1 and 4 | D | 1000 | .003 | a | 61.53 |
| 1 and 5 | A | 480 | .003 | a | 41.89 |
| 1 and 5 | B | 240 | 11.2 | c | 93.44 |
| 1 and 5 | C | 850 | 20.4 | a | 190.70 |
| 1 and 5 | D | 900 | .007 | a | 70.48 |

TABLE III-continued

| FLUID(S) | PARTICLE | YIELD STRESS Pa @ 2 KV/mm | CURRENT DENSITY | DISPERSION STABILITY uA/cm$^2$ | VISCOSITY (CP) RATING |
|---|---|---|---|---|---|
| 1 and 6 | A | — | — | — | >5000.00 |
| 1 and 6 | B | — | — | — | >5000.00 |
| 1 and 6 | C | — | — | — | >5000.00 |
| 1 and 6 | D | — | — | — | >5000.00 |
| 1 and 7 | A | 310 | .003 | c | 123.40 |
| 1 and 7 | B | 360 | 10.2 | c | 251.50 |
| 1 and 7 | C | 1000 | 14.3 | a | 3882.00 |
| 1 and 7 | D | 570 | .008 | a | 1855.00 |

Surprisingly it has been found that alkylmethylsiloxane fluid mixtures of the present invention can be used to form compatible ER fluid systems with organofluoro containing compounds and numerous organic and siloxane polymer based particle materials with the following advantages observed. The low specific gravity of the alkylmethylsiloxane fluids (0.8 to 1.0) enables the fluid phase of ER fluids based on a high specific gravity CTFE fluid to vary from 0.9 to 1.9. This enables specific gravity matching of an extended range of particle systems. The addition of alkylmethylsiloxane fluids reduces the loss current of ER fluids when compared to fluids based on CTFE or CTFE/fluorosilicone blends, and also results in improved yield stress properties with corn starch particle systems and reduced viscosities while maintaining high yield stress performance with aminosiloxane sulfate ionomer particles.

The alkylmethylsiloxane compounds of the present invention also maintain .the good lubricity of CTFE based systems since the alkylmethylsiloxane fluids are excellent lubricants in their own right. Also, when compared directly to PDMS based ER fluids, the alkylmethylsiloxane fluids of the present invention exhibit comparable yield stress performance and greatly enhanced lubricity characteristics in zeolite and aminosiloxane ionomer particle systems.

It should be apparent from the foregoing that many other variations and modifications may be made in the compounds, compositions and methods described herein without departing substantially from the essential features and concepts of the present invention. Accordingly it should be clearly understood that the forms of the invention described herein are exemplary only and are not intended as limitations on the scope of the present invention as defined in the appended claims.

That which is claimed is:

1. An electrorheological fluid composition comprising:

(A) solid particles having a specific gravity of less than 1.8;

(B) an alkylmethylsiloxane compound having a specific gravity of between 0.8 and 1.0 and having its formula selected from the group consisting of:

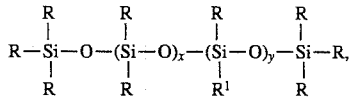

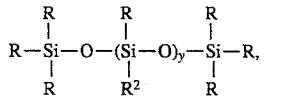

-continued

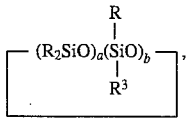

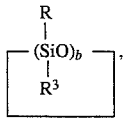

and mixtures thereof; and (C) an organofluoro compound having a specific gravity of greater than 1.5 and selected from the group consisting of perfluoropolyethers, perfluorodecalin, perfluoromethyldecalin, and a compound selected from the group consisting of (i) $(CR^5R^6—CR^7R^8)_n$ and (ii) $F_3C(CF_2—CF_2)_nCF_3$;

wherein each R is a radical independently selected from the group consisting of alkyl radicals having from 1 to 20 carbon atoms and aryl radicals, $R^1$, $R^2$, $R^3$, and $R^4$ have the general formula $(CH_2)_dCH_3$ and d has an average value from 5 to 11, x has an average value from 1 to 100, y has an average value from 1 to 100, a has an average value from 1 to 9, b has an average value from 1 to 10, $R^5$, $R^6$, $R^7$, and $R^8$are selected from hydrogen, chlorine, or fluorine, with the proviso that at least one of $R^5$, $R^6$, $R^7$, and $R^8$ is a fluoro group, and n is such that the viscosity of (i) and (ii) is less than 500 centistokes at 25° C. with the proviso that the mixture has a viscosity of below 10,000 centistokes at 25° C., with the proviso that (B) is miscible with (C), and wherein the average specific gravity of (B) plus (C) is within 0.2 of the specific gravity of (A).

2. A composition according to claim 1, wherein (i) is chlorotrifluoroethylene.

3. A composition according to claim 1, wherein d has a value from 9 to 11.

4. A composition according to claim 1, wherein (B) is a linear siloxane.

5. A composition according to claim 1, wherein (B) is a cyclic siloxane.

6. A composition according to claim 1, wherein (C) has a viscosity of from 10 to 1,000 centistokes at 25° C.

7. A composition according to claim 1, wherein (C) has a viscosity of from 20 to 300 centistokes at 25° C.

8. A composition according to claim 1, wherein (C) has a viscosity of from 20 to 100 centistokes at 25° C.

9. A composition according to claim 1, wherein the solid particles (A) are selected from the group consisting of acid group-containing polymers, silica gel, starch, zeolite, acrylamides, and sulfate ionomers.

10. A composition according to claim 9, wherein the sulfate ionomer is an aminosiloxane sulfate ionomer.

11. A composition according to claim 9, wherein the acid group containing polymer is an addition polymer.

12. A composition according to claim 11, wherein the addition polymer is derived from one or more monomers selected from the group consisting of acrylic acid, methacrylic acid, methyl acrylate, and methyl methacrylate.

13. A composition according to claim 12, wherein the addition polymer is a salt of polymethacrylic acid.

14. A composition according to claim 13, wherein the salt has one or more metal cations selected from the group consisting of lithium, sodium, potassium, copper, magnesium, aluminum, and chromium.

15. A composition according to claim 14, wherein the metal cation is lithium.

16. A composition according to claim 1, wherein the plurality of solid particles have an average particle size of from 1 to 50 microns.

17. A composition according to claim 1, wherein the electrically non-conducting liquid contains from 20% to 40% by volume of the solid particles.

18. A method of using an electrorheological fluid composition comprising:

(I) applying an electric field across the electrorheological fluid composition, said electrorheological fluid composition comprising:

(A) solid particles having a specific gravity of less than 1.8;

(B) an alkylmethylsiloxane compound having a specific gravity of between 0.8 and 1.0 and having its formula selected from the group consisting of:

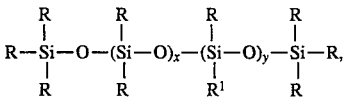

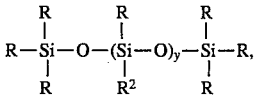

-continued

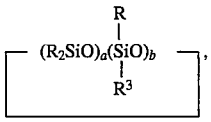

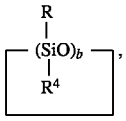

and mixtures thereof; and (C) an organofluoro compound having a specific gravity of greater than 1.5 and selected from the group consisting of perfluoropolyethers, perfluorodecalin, perfluoromethyldecalin, and a compound selected from the group consisting of (i) $(CR^5R^6—CR^7R^8)_n$ and (ii) $F_3C(CF_2—CF_2)_nCF_3$;

wherein each R is a radical independently selected from the group consisting of alkyl radicals having from 1 to 20 carbon atoms and aryl radicals $R^1$, $R^2$, $R^3$, and $R^4$ have the general formula $(CH_2)_dCH_3$ and d has an average value from 5 to 11, x has an average value from 1 to 100, y has an average value from 1 to 100, a has an average value from 1 to 9, b has an average value from 1 to 10, $R^5$, $R^6$, $R^7$, and $R^8$ are selected from hydrogen, chlorine, or fluorine, with the proviso that at least one of $R^5$, $R^6$, $R^7$, and $R^8$ is a fluoro group, and n is such that the viscosity of (i) and (ii) is less than 500 centistokes at 25° C. with the proviso that the mixture has a viscosity of below 10,000 centistokes at 25° C., with the proviso that (B) is miscible with (C), and wherein the average specific gravity of (B) plus (C) is within 0.2 of the specific gravity of (A).

* * * * *